US011242862B2

(12) United States Patent
Shiraishi et al.

(10) Patent No.: US 11,242,862 B2
(45) Date of Patent: Feb. 8, 2022

(54) BLOWER DEVICE

(71) Applicant: Nidec Corporation, Kyoto (JP)

(72) Inventors: Yukinobu Shiraishi, Kyoto (JP); Takashi Uchino, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 0 days.

(21) Appl. No.: 17/015,888

(22) Filed: Sep. 9, 2020

(65) Prior Publication Data

US 2021/0095686 A1 Apr. 1, 2021

(30) Foreign Application Priority Data

Sep. 26, 2019 (JP) ..... JP2019-176165

(51) Int. Cl.
*F04D 29/28* (2006.01)

(52) U.S. Cl.
CPC ..... *F04D 29/281* (2013.01); *F05D 2260/37* (2013.01)

(58) Field of Classification Search
CPC ..... F04D 29/281; F04D 29/263
See application file for complete search history.

(56) References Cited

U.S. PATENT DOCUMENTS

| | | | | |
|---|---|---|---|---|
| 7,585,154 | B2 * | 9/2009 | Lan | F04D 25/082 416/175 |
| 7,903,406 | B2 * | 3/2011 | Takemoto | F04D 25/0633 361/695 |
| 9,599,123 | B2 * | 3/2017 | Tamaoka | F04D 29/441 |
| 9,963,970 | B2 * | 5/2018 | Lee | F01D 5/00 |
| 2017/0130724 | A1 | 5/2017 | Bielesch et al. | |

* cited by examiner

*Primary Examiner* — Ninh H. Nguyen
(74) *Attorney, Agent, or Firm* — Keating & Bennett

(57) ABSTRACT

A blower device includes a rotor rotatable about a central axis extending in a vertical direction, an impeller attached to the rotor, and an annular ring centered on the central axis. The rotor includes a rotor cylindrical portion that extends in the axial direction and a flange that extends radially outward from the rotor cylindrical portion. The impeller includes an annular impeller base centered on the central axis. The ring is connected to the impeller base in the axial direction. The flange is held between the impeller base and the ring in the axial direction.

11 Claims, 5 Drawing Sheets

【Fig.1】
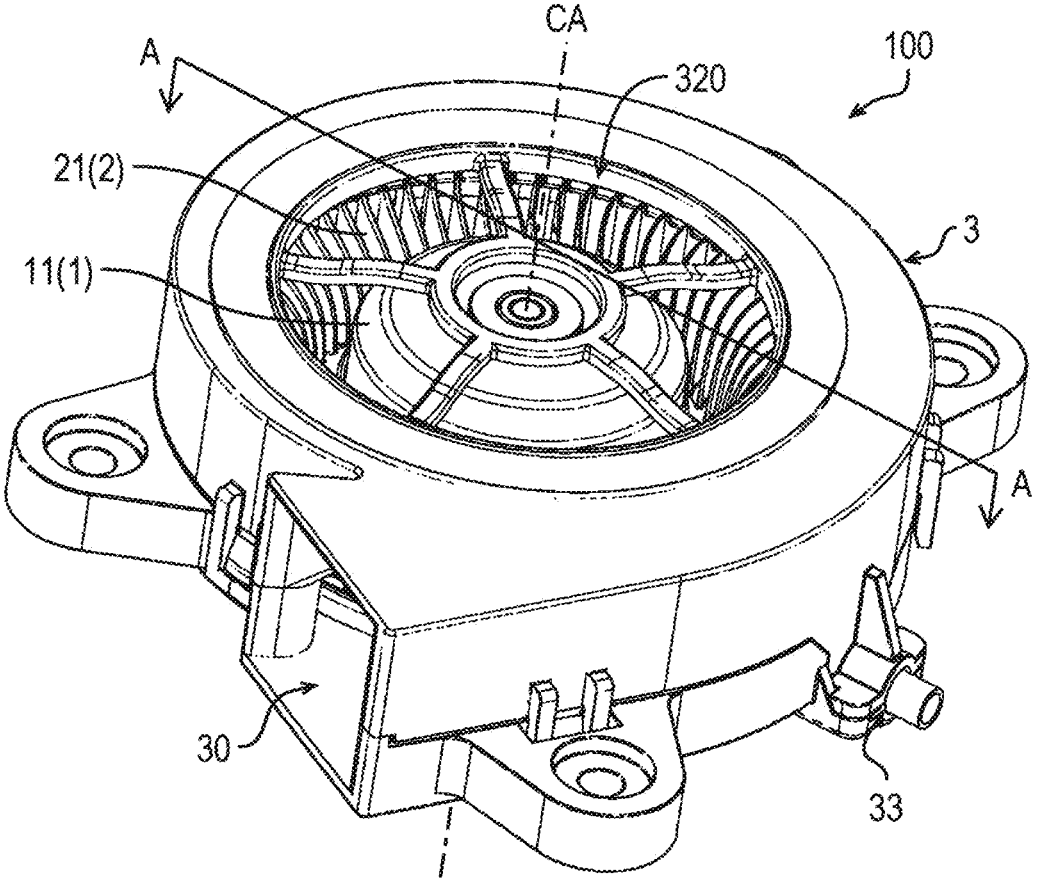

【Fig.2】
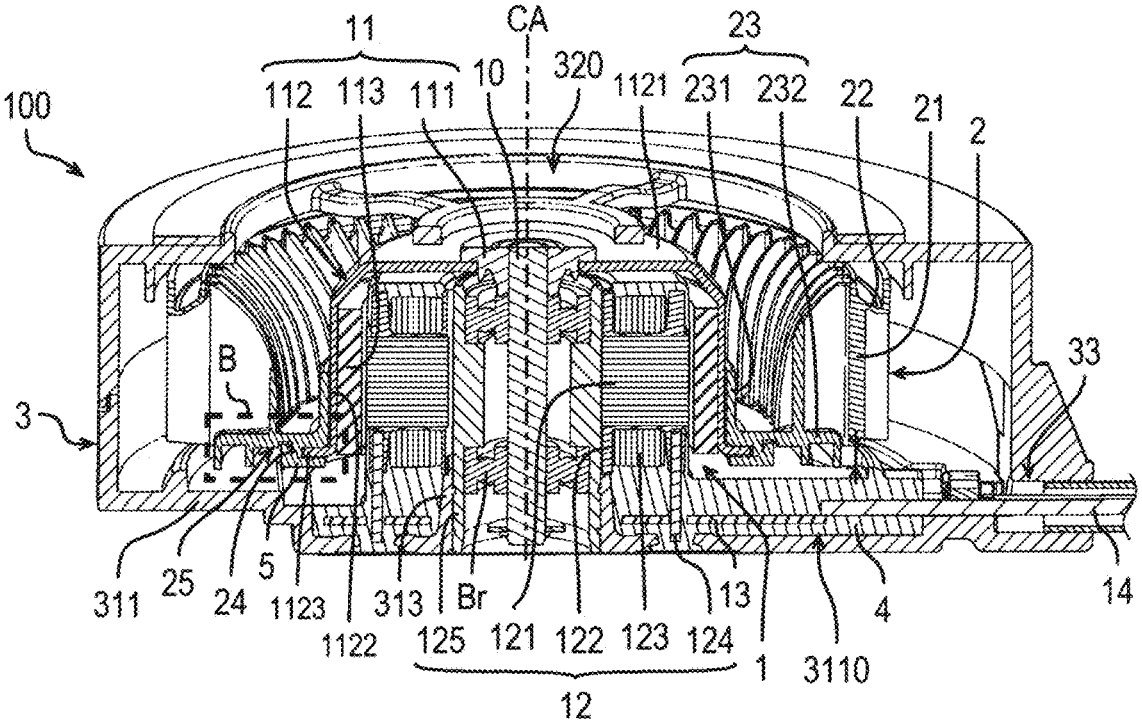

【Fig.3】
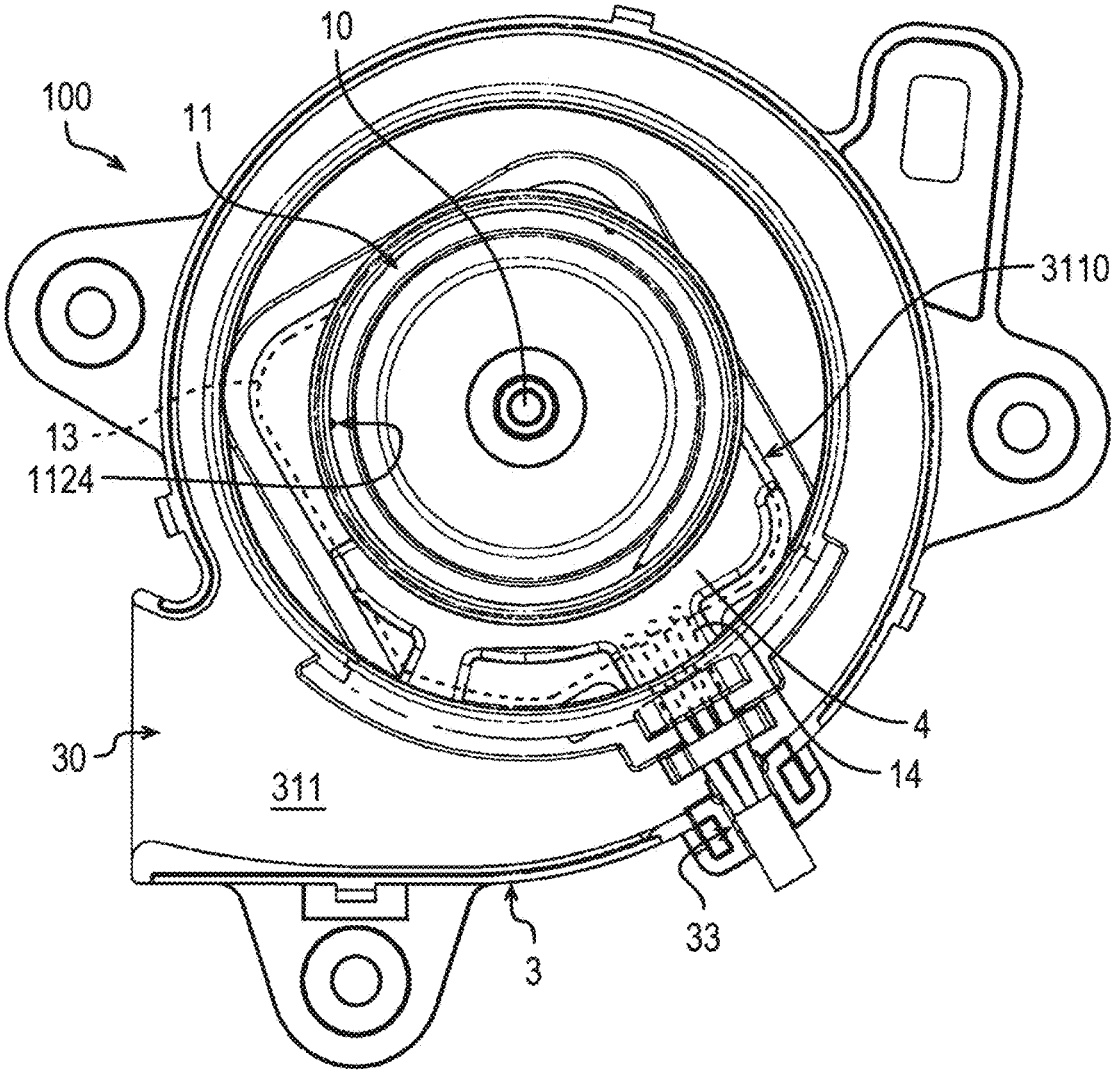

【Fig.4】
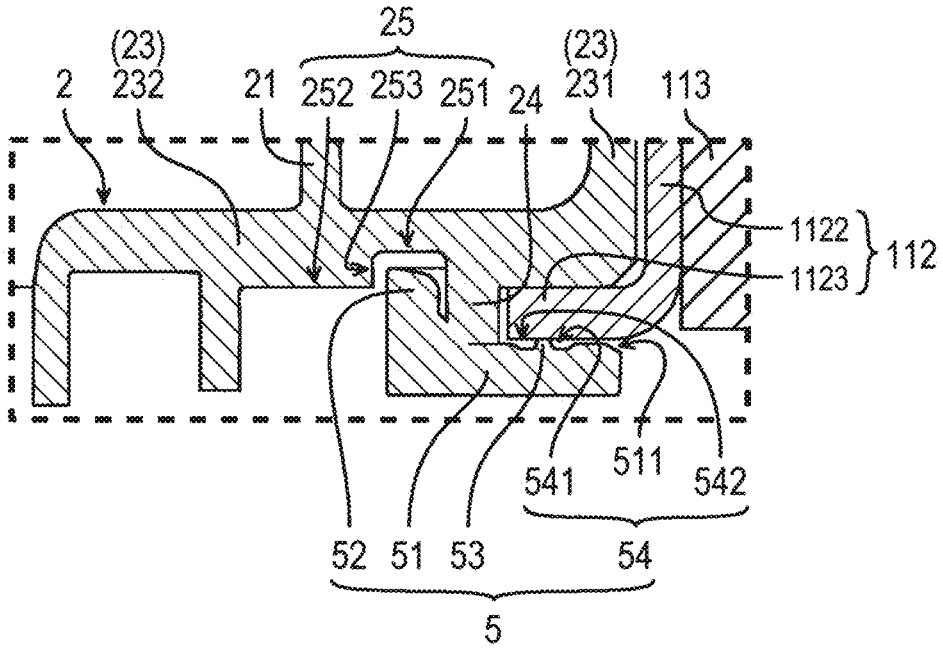

【Fig. 5 A】
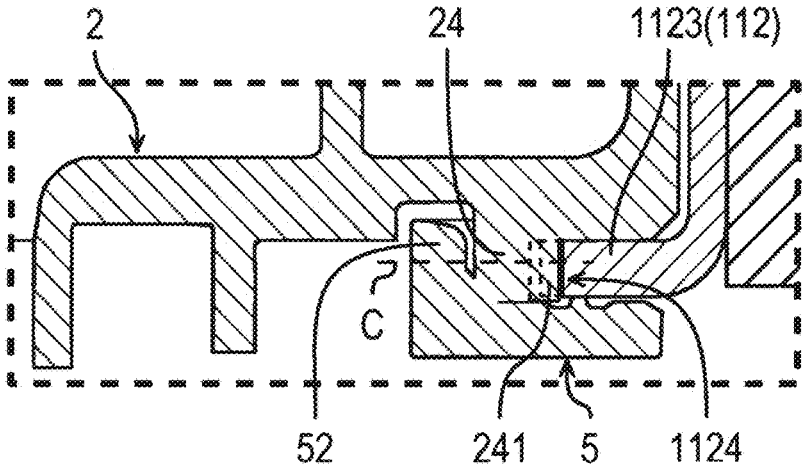
【Fig. 5 B】
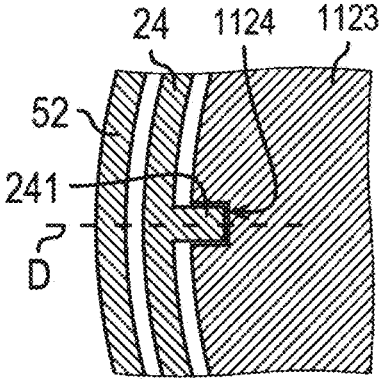

BLOWER DEVICE

CROSS REFERENCE TO RELATED APPLICATION

The present application claims priority under 35 U.S.C. § 119 to Japanese Application No. 2019-176165 filed on Sep. 26, 2019, the entire contents of which are hereby incorporated herein by reference.

1. FIELD OF THE INVENTION

The present disclosure relates to a blower device.

2. BACKGROUND

Conventionally, a blower device in which an impeller is attached to a rotor using a method such as detent connection has been known. In the detent connection, a movement stopper hook provided on the impeller engages with the edge of a rotor hub, for example.

However, depending on operating conditions and an operating environment of the blower device, a large force may be exerted on the connection portion between the impeller and the rotor. Therefore, a method for more rigidly fixing the impeller and the rotor than the abovementioned detent connection has been demanded.

SUMMARY

A blower device according to an example embodiment of the present disclosure includes a rotor rotatable about a central axis extending in a vertical direction, an impeller attached to the rotor, and an annular ring centered on the central axis. The rotor includes a rotor cylindrical portion that extends in the axial direction and a flange that extends radially outward from the rotor cylindrical portion. The impeller includes an annular impeller base centered on the central axis. The ring is connected to the impeller base in the axial direction. The flange is held between the impeller base and the ring in the axial direction.

The above and other elements, features, steps, characteristics and advantages of the present disclosure will become more apparent from the following detailed description of the example embodiments with reference to the attached drawings.

BRIEF DESCRIPTION OF THE DRAWINGS

FIG. 1 is a perspective view of a centrifugal fan.

FIG. 2 is a sectional perspective view of the centrifugal fan cut along a central axis.

FIG. 3 is a plan view of the centrifugal fan as viewed in the axial direction.

FIG. 4 is an enlarged view of a cross-sectional structure near the ring member.

FIG. 5A is an enlarged view of a cross-sectional structure in the vicinity of the ring member as viewed in the radial direction according to a modification.

FIG. 5B is an enlarged view of the cross-sectional structure in the vicinity of the ring member as viewed in the axial direction according to the modification.

DETAILED DESCRIPTION

Example embodiments of the present disclosure and modifications thereof will be described with reference to the drawings. In the present specification, in a centrifugal fan 100, a direction parallel to a central axis CA is referred to as the term "axial direction", "axial", or "axially". In the axial direction, the direction from a substrate 13 to a stator core 121 is referred to as the term "upper" or "upward", and the direction from the stator core 121 to the substrate 13 is referred to as the term "lower" or "downward". In each component, an upper side end is referred to as the term "upper end" and a lower side end is referred to as the term "lower end". Further, on the surface of each component, the surface facing upward is referred to as the term "upper surface", and the surface facing downward is referred to as the term "lower surface".

The direction orthogonal to the central axis CA is referred to as the term "radial direction", "radial", or "radially". In the radial direction, the direction toward the central axis CA is referred to as the term "radially inward", and the direction away from the central axis CA is referred to as the term "radially outward". In each component, a radially inward end is referred to as the term "radially inner end", and a radially outward end is referred to as the term "radially outer end". In addition, regarding side surfaces of each component, a side surface directed in the radial direction is referred to as the term "radial side surface". Further, the side surface directed radially inward is referred to as the term "radially inner side surface", and the side surface directed radially outward is referred to as the term "radially outer side surface".

The direction of rotation about the central axis CA is referred to as the term "circumferential direction", "circumferential", or "circumferentially. In each component, an end in the circumferential direction is referred to as the term "circumferential end". One side in the circumferential direction is referred to as the term "one circumferential side", and the other side in the circumferential direction is referred to as the term "other circumferential side". Further, one end on one circumferential side is referred to as the term "one circumferential end", and the other end on the other circumferential side is referred to as the term "other circumferential end". In addition, regarding side surfaces of each component, a side surface directed in the circumferential direction is referred to as the term "circumferential side surface". Further, the side surface directed to one circumferential side is referred to as the term "one circumferential side surface", and the side surface directed to the other circumferential side is referred to as the term "other circumferential side surface".

In the present specification, the term "annular" indicates a shape that is continuous without having any discontinuous portions over the entire circumference in the circumferential direction about the central axis CA, unless otherwise specified. The term "annular" also includes a shape having a closed curve on a curved surface that intersects with the central axis CA with the central axis CA as the center.

In the positional relationship between any one of the azimuth, line, and plane and another one of them, the term "parallel" indicates not only a state in which they do not intersect at any point but also a state in which they are substantially parallel. The terms "vertical" and "orthogonal" indicate not only a state in which they intersect at 90 degrees with each other, but also a state in which they are substantially vertical and a state in which they are substantially orthogonal. That is, the terms "parallel", "vertical", and "orthogonal" each include a state in which the positional relationship between them has an angular deviation that does not depart from the gist of the present disclosure.

The matters described above are not strictly applied when incorporated in an actual device.

FIG. 1 is a perspective view of the centrifugal fan 100. FIG. 2 is a sectional perspective view of the centrifugal fan 100 cut along the central axis CA. FIG. 3 is a plan view of the centrifugal fan 100 as viewed in the axial direction. FIG. 2 is a sectional view taken along a line A-A in FIG. 1 and shows a cross-sectional structure of the centrifugal fan 100 when the centrifugal fan 100 is cut along a virtual plane parallel to the central axis CA extending in the vertical direction. In FIG. 3, an upper part of a housing 3 and an impeller 2 are not shown for clarity.

The centrifugal fan 100 is a blower device that sucks air through an upper opening 320 serving as an intake port and discharges an airflow from a side opening 30 serving as a discharge port. As shown in FIG. 2, the centrifugal fan 100 includes a motor 1, an impeller 2 having a plurality of blades 21, a housing 3, a resin filled part 4, and a ring member 5.

The configuration of the motor 1 will be described with reference to FIGS. 1 to 3. The motor 1 is a drive device that rotationally drives the impeller 2. As shown in FIG. 2, the motor 1 has a shaft 10, a rotor 11, a stator 12, a substrate 13, and a lead wire 14. In other words, the centrifugal fan 100 includes the shaft 10, the rotor 11, the stator 12, the substrate 13, and the lead wire 14.

The shaft 10 is a rotation axis of the rotor 11, supports the rotor 11, and is rotatable with the rotor 11 about the central axis CA. Note that the shaft 10 is not limited to the example in the example embodiment, and may be a fixed shaft attached to the stator 12. If the shaft 10 is a fixed shaft, a bearing (not shown) is disposed between the rotor 11 and the shaft 10.

The rotor 11 is rotatable about the central axis CA that extends in the vertical direction. The rotor 11 can rotate together with the plurality of blades 21. As described above, the centrifugal fan 100 includes the rotor 11. The impeller 2 is attached to the rotor 11. As shown in FIG. 2, the rotor 11 includes a rotor hub 111, a rotor yoke 112, and a magnet 113.

The rotor hub 111 is attached to the upper part of the shaft 10 and extends in the radial direction from the radially outer surface of the shaft 10. The rotor yoke 112 is a magnetic body. The rotor yoke 112 has a rotor lid 1121, a rotor cylindrical part 1122, and a flange 1123. The rotor lid 1121 extends radially outward from the rotor hub 111. The rotor cylindrical part 1122 has a cylindrical shape extending in the axial direction. The rotor 11 has the rotor cylindrical part 1122. The rotor cylindrical part 1122 extends at least downward from the radially outer end of the rotor lid 1121. The flange 1123 extends radially outward from the rotor cylindrical part 1122. The rotor 11 has the flange 1123. In the present example embodiment, the flange 1123 extends radially outward from the lower end of the rotor cylindrical part 1122.

Further, one or more flange recesses 1124 are formed in the radially outer end of the flange 1123. The flange recess 1124 is recessed radially inward from the radially outer end of the flange 1123 and opens at the upper surface of the flange 1123. In the present example embodiment, the flange recess 1124 penetrates the flange 1123 in the axial direction. However, the flange recess 1124 is not limited to this example, and may not penetrate the flange 1123 in the axial direction. Alternatively, the flange recess 1124 may not be formed.

The magnet 113 is held on the radially inner side surface of the rotor cylindrical part 1122. The magnet 113 has a cylindrical shape surrounding the central axis CA and extends in the axial direction. The magnet 113 is located radially outside the stator 12 and faces the radially outer surface of the stator 12 in the radial direction. The magnet 113 is, for example, a rare earth sintered magnet such as a ferrite magnet or a neodymium sintered magnet, and has a plurality of magnetic poles different from each other, that is, N poles and S poles. The N poles and S poles are arranged alternately in the circumferential direction.

The stator 12 has an annular shape centered on the central axis CA and is held by the housing 3. The stator 12 supports the rotor 11, and drives and rotates the rotor 11 when the motor 1 is driven. The stator 12 includes a stator core 121, an insulator 122, a plurality of coils 123, a wire-wrapped pin 124, and a bearing holder 125.

The stator core 121 surrounds the central axis CA that extends in the vertical direction. The stator core 121 is a magnetic body, and is a laminated body obtained by a plurality of electromagnetic steel plates laminated in the axial direction in the present example embodiment.

The insulator 122 covers a portion of the stator core 121. The insulator 122 is formed of a material having electrical insulation such as synthetic resin, enamel, and rubber.

Each coil 123 is formed by winding a conductive wire (not denoted by a reference numeral) around the stator core 121 via the insulator 122. When a drive current is supplied to each coil 123, the stator 12 is excited and drives the rotor 11. The conductive wire is, for example, a metal wire covered with an insulating material, such as an enamel-coated copper wire. The end of the conductive wire is wound around the wire-wrapped pin 124, and is electrically connected to the substrate 13 via the wire-wrapped pin 124.

The wire-wrapped pin 124 extends downward from the insulator 122 in the lower portion of the stator 12. The wire-wrapped pin 124 is made of metal, for example, and is connected to the substrate 13.

The bearing holder 125 has a cylindrical shape extended in the axial direction, and rotatably supports the shaft 10 via a bearing Br. Further, the stator core 121 is fixed to the radially outer surface of the bearing holder 125.

The substrate 13 is disposed below the stator 12 and equipped with a drive circuit and the like. The wire-wrapped pin 124 and the lead wire 14 are electrically connected to the substrate 13. The lead wire 14 is a connection wire drawn from the inside of the housing 3 to the outside through a lead port 33. The lead wire 14 electrically connects the substrate 13 to a device or the like outside the housing 3.

The configuration of the impeller 2 will be described with reference to FIGS. 1 and 2. The impeller 2 is driven by the motor 1 to rotate about the central axis CA. Thus, the air sucked through the upper opening 320 is delivered radially outward as an airflow. The delivered airflow flows in the housing 3 in the circumferential direction, and is discharged to the outside of the housing 3 through the side opening 30. As shown in FIG. 2, the impeller 2 further includes a bracket 22, an impeller base 23, an impeller first protrusion 24, and an impeller second protrusion 25, in addition to the plurality of blades 21.

The plurality of blades 21 is arranged in the circumferential direction about the central axis CA extending in the vertical direction. Each blade 21 extends in a direction including at least radial direction, out of the radial direction and the circumferential direction, and also extends in the axial direction.

The bracket 22 has an annular shape centered on the central axis CA. The upper ends of the blades 21 are connected to the bracket 22.

The impeller base 23 has an annular shape centered on the central axis CA. As described above, the impeller 2 further includes the impeller base 23. The impeller base 23 has a base cylindrical part 231 and a base annular part 232. The base cylindrical part 231 has a cylindrical shape extending in the axial direction. The rotor cylindrical part 1122 is fitted inside the base cylindrical part 231. The radially inner side surface of the base cylindrical part 231 contacts the radially outer side surface of the rotor cylindrical part 1122. The base cylindrical part 231 may be connected to the rotor cylindrical part 1122 using an adhesive or the like. The base annular part 232 has an annular shape centered on the central axis CA and extends radially outward from the lower end of the base cylindrical part 231. The radially inner end of the base annular part 232 is in contact with the upper surface of the flange 1123. The lower ends of the blades 21 are connected to the radially outer end of the base annular part 232.

The impeller first protrusion 24 protrudes downward from the lower surface of the impeller base 23. As described above, the impeller base 23 has the impeller first protrusion 24. More specifically, the impeller first protrusion 24 protrudes downward from the lower surface of the base annular part 232. The impeller first protrusion 24 is disposed radially outward of the flange 1123.

The impeller 2 will be described with reference to FIGS. 2 and 4. FIG. 4 is an enlarged view of a cross-sectional structure near the ring member 5. FIG. 4 is an enlarged sectional view of a portion B encircled by a broken line in FIG. 2. The impeller second protrusion 25 is formed on the lower surface of the base annular part 232. The impeller second protrusion 25 includes a first lower surface 251, a second lower surface 252, and an inner side surface 253. The first lower surface 251 and the second lower surface 252 are different areas of the lower surface of the base annular part 232. The first lower surface 251 is located above the second lower surface 252. The upper end of the inner side surface 253 is connected to the radially outer end of the first lower surface 251. The lower end of the inner side surface 253 is connected to the radially inner end of the second lower surface 252.

In the present example embodiment, the impeller second protrusion 25 protrudes downward from the first lower surface 251. In other words, in the present example embodiment, the impeller second protrusion 25 is a stepped part constituted by the first lower surface 251 and the second lower surface 252 which are located at different positions in the axial direction, and the inner side surface 253 connecting both surfaces. However, the present disclosure is not limited to this example, and the impeller second protrusion 25 may be defined by an angle between the lower surface of a protrusion that protrudes downward from the lower surface of the base annular part 232 and the radially inner side surface of the protrusion.

The housing 3 will be described with reference to FIGS. 1 to 3. The housing 3 houses the motor 1 and the impeller 2. The upper opening 320 is formed in the upper surface of the housing 3. The side opening 30 and the lead port 33 are formed in the radial side surface of the housing 3.

The bottom plate 311 of the housing 3 is provided with an opening (not denoted by a reference numeral) formed in the upper surface so as to surround the central axis CA. The housing cylindrical part 313 that is cylindrical and extends along the axial direction protrudes upward on the radially inner end of the bottom plate 311 along the opening. The lower portion of the bearing holder 125 is located inside the housing cylindrical part 313. The motor 1 is held in the housing 3 by the housing cylindrical part 313 holding the bearing holder 125.

The housing recess 3110 is formed in the upper surface of the bottom plate 311. The housing recess 3110 is recessed downward from the upper surface of the bottom plate 311. The substrate 13 and the end of the lead wire 14 on the substrate 13 side are housed in the housing recess 3110.

The resin filled part 4 will be described with reference to FIG. 2. The resin filled part 4 is filled in the housing recess 3110. A thermoplastic resin material such as polyamide is used for the resin filled part 4, for example. Due to the configuration in which the housing recess 3110 that houses the substrate 13 and the end of the lead wire 14 on the substrate 13 side is filled with a resin material, the resin filled part 4 can cover the substrate 13 and the end of the lead wire 14 on the substrate 13 side. This makes it possible to protect the substrate 13 and the connection portion between the substrate 13 and the lead wire 14 from water, dust, and the like. Further, the connection portion between a connecting wire other than the lead wire 14 and the substrate 13 can be protected from water, dust and the like. Further, the resin filled part 4 can stably fix the substrate 13 and the end of the lead wire 14 on the substrate 13 side without using a fixing member different from the resin filled part 4. Moreover, the resin filled part 4 covers the surface of the stator 12. Due to the resin filled part 4 covering or sealing the stator 12, the waterproof property and dustproof property of the stator 12 can be improved.

The ring member 5 will be described with reference to FIGS. 2 and 4.

The ring member 5 has an annular shape centered on the central axis CA. As described above, the centrifugal fan 100 includes the ring member 5. The ring member 5 is axially connected to the impeller base 23, and holds the flange 1123 with the base annular part 232 of the impeller base 23 in the axial direction. That is, the flange 1123 is held between the impeller base 23 and the ring member 5 in the axial direction. Thus, the impeller 2 can be rigidly fixed to the rotor 11.

The impeller first protrusion 24 is connected to the ring member 5. Since the impeller first protrusion 24 and the ring member 5 are connected to each other, the impeller 2 can be more rigidly fixed to the rotor 11.

For example, in the present example embodiment, the tip of the impeller first protrusion 24 is welded to the ring member 5. Note that ultrasonic welding or heat welding can be used for welding, for example. Welding does not need to use a connecting member, and whereby the impeller first protrusion 24 and the ring member 5 can be rigidly connected without increasing the number of components.

The present disclosure is not limited to the example of the present example embodiment, and the tip of the impeller first protrusion 24 may be connected to the ring member 5 by another connecting means. For example, an adhesive may be used for connecting the tip of the impeller first protrusion 24 and the ring member 5.

In the present example embodiment, the ring member 5 is made of a composite resin material in which glass fiber is mixed with thermoplastic resin. Preferably, a material same as the material of the impeller 2 is used for the ring member 5. This makes it easy to connect the ring member 5 to the impeller 2 by welding or other methods. However, the present disclosure is not limited to this example, and the impeller 2 and the ring member 5 may be made of different materials.

The lower surface of the flange 1123 is connected to the ring member 5. In the present example embodiment, the lower surface of the flange 1123 is in pressing contact with the ring member 5. Thus, the impeller 2 can be more rigidly fixed to the rotor 11.

In the present example embodiment, the pressure contact portion between the lower surface of the flange 1123 and the ring member 5 is located radially outward of the radially inner end of the ring member 5. Since the pressure contact portion is located distant from the radially inner end of the ring member 5 in the radially outward direction, the melted resin material is unlikely to leak to the outside between the lower surface of the flange 1123 and the ring member 5 when the ring member 5 is pressed against the lower surface of the flange 1123. Therefore, it is possible to prevent the melted resin material from entering, for example, the motor 1 as dust or burr or from being mixed with the airflow discharged from the centrifugal fan 100.

The present disclosure is not limited to the above example, and the lower surface of the flange 1123 may be connected to the ring member 5 by another connecting means. For example, an adhesive may be used for connecting the tip of the impeller first protrusion 24 and the ring member 5.

The ring member 5 has an annular part 51, a ring first protrusion 52, a ring second protrusion 53, and a groove 54.

The annular part 51 has an annular shape centered on the central axis CA and extends in the radial direction. Preferably, round chamfering for forming a curved surface between the upper surface and the radially inner side surface of the annular part 51 is performed in the corner part formed by the upper surface and the radially inner surface of the annular part 51, or beveling for diagonally cutting a corner of the corner part is performed in the corner part. For example, the radially inner end of the upper surface of the ring member 5 has an inclined surface 511 that extends downward toward the radially inner side as shown in FIG. 4. The shape of the inclined surface 511 viewed in the circumferential direction may be linear. Alternatively, the inclined surface may have a shape protruding upward and radially outward, or a shape recessed downward and radially inward. Further, the inclined surface 511 may be a curved surface curving downward toward the radially inner side. With this configuration, the corner between the radially inner end of the upper surface and the upper end of the radially inner end surface of the ring member 5 can be chamfered. Due to chamfering of the corner, the distance between the lower surface of the flange 1123 and the ring member 5 can be appropriately maintained. Therefore, when the ring member 5 is pressed against the lower surface of the flange 1123, for example, the pressure contact portion between them can be separated from the radially inner end of the upper surface of the ring member 5.

The ring first protrusion 52 is located radially outward of the impeller first protrusion 24, and protrudes upward. As described above, the ring member 5 has the ring first protrusion 52. More specifically, the ring first protrusion 52 protrudes upward from the annular part 51 and is located radially outward of the impeller first protrusion 24. The ring first protrusion 52 faces the impeller first protrusion 24 in the radial direction. With this configuration, even if dust is generated at the connection portion between the impeller first protrusion 24 and the ring member 5, the ring first protrusion 52 can prevent leakage of dust from the space between the impeller base 23 and the ring member 5 to the outside. Dust is, for example, a fragment of a melted resin material, such as a burr, which is generated during pressure contact. Alternatively, when an adhesive is used, the dust is a strip of hardened adhesive. Therefore, it is possible to prevent dust generated at the connection portion from entering the motor 1 or being mixed with the airflow discharged from the centrifugal fan 100, for example.

The impeller second protrusion 25 is formed on the lower surface of the impeller base at the outside of the ring first protrusion 52 in the radial direction. As described above, the impeller second protrusion 25 has the first lower surface 251, the second lower surface 252, and the inner side surface 253. The first lower surface 251 is located above the ring first protrusion 52. The second lower surface 252 is located radially outward of the ring first protrusion 52. The second lower surface 252 is located below the upper end of the ring first protrusion 52. The inner side surface 253 connects the radially outer end of the first lower surface 251 and the radially inner end of the second lower surface 252. The inner side surface 253 of the impeller second protrusion 25 faces the ring first protrusion 52 in the radial direction. With this configuration, even if dust is generated at the connection portion between the impeller first protrusion 24 and the ring member 5, a leakage of dust from the space between the impeller base 23 and the ring member 5 to the outside can be prevented by a labyrinth structure constituted by the ring first protrusion 52 and the impeller second protrusion 25.

The ring second protrusion 53 protrudes upward from the upper surface of the ring member 5. As described above, the ring member 5 has the ring second protrusion 53. More specifically, the ring second protrusion 53 protrudes upward from the upper surface of the annular part 51 at the inside of the ring first protrusion 52 in the radial direction. The upper end of the ring second protrusion 53 is connected to the lower surface of the flange 1123 of the rotor 11. In the present example embodiment, the upper end of the ring second protrusion 53 is pressed against the lower surface of the flange 1123. With this configuration, the ring member 5 can be easily connected to the flange 1123 by bringing the tip of the ring second protrusion 53 into contact with the lower surface of the flange 1123 and applying pressure thereto. Further, even when at least one of the lower surface of the flange 1123 and the ring member 5 has a dimensional tolerance in the axial direction, the relative arrangement between the lower surface of the flange 1123 and the ring member 5 in the axial direction is corrected by pressure contact of the tip of the ring second protrusion 53. That is, even when, for example, the axial length of the ring second protrusion 53 is too long, the tip of the ring second protrusion 53 is melted during pressure contact, so that the tip of the ring second protrusion 53 and the lower surface of the flange 1123 are fixed to have a preferable arrangement in the axial direction. The present disclosure is not limited to this example, and the upper end of the ring second protrusion 53 may be connected to the lower surface of the flange 1123 of the rotor 11 by another connecting means such as an adhesive.

The groove 54 is formed in the upper surface of the ring member 5 so as to be recessed downward and extend in the circumferential direction. More specifically, the groove 54 is formed in the upper surface of the annular part 51 so as to be recessed downward from the upper surface and extend in the circumferential direction. The groove 54 is preferably formed near the ring second protrusion 53 as shown in FIG. 4.

In the present example embodiment, the groove 54 includes a first groove 541 and a second groove 542. The ring second protrusion 53 and the lower surface of the flange 1123 are pressed against each other. The first groove 541 is recessed downward and extends in the circumferential direction at a position radially inward of the pressure contact portion. The second groove 542 is recessed downward and extends in the circumferential direction at a position radially outward of the pressure contact portion. In the present example embodiment, the first groove 541 and the second groove 542 have a closed curve shape surrounding the central axis CA. However, the present disclosure is not limited to this example, and each of the first groove 541 and the second groove 542 may not have a closed curve shape surrounding the central axis CA, but may be, for example, a groove having one or more arcs.

The groove 54 is not limited to the example in the present example embodiment, and may include either the first groove 541 or the second groove 542. That is, the groove 54 only needs to have at least one of the first groove 541 and the second groove 542. This configuration makes it possible to collect the resin material, which is melted during pressure contact and flows in the radial direction, into the first groove 541 and/or the second groove 542. Alternatively, if an adhesive is used, an excess adhesive can be collected in the first groove 541 and/or the second groove 542. Therefore, the melting and flowing resin material, an excess adhesive, etc., is even less likely to leak to the outside of the space between the lower surface of the flange 1123 and the ring member 5. It is possible to suppress the generation of dust which may be fragments of melted resin material such as burrs or strips of hardened adhesive in the abovementioned connection portion.

A modification of the ring member 5 will be described with reference to FIGS. 5A and 5B. FIGS. 5A and 5B show the modification of the ring member 5 and the flange 1123. FIG. 5A is an enlarged view of the cross-sectional structure near the ring member 5 as viewed in the radial direction in the modification. FIG. 5B is an enlarged view of the cross-sectional structure near the ring member 5 as viewed in the axial direction in the modification. FIG. 5A shows the cross-sectional structure corresponding to a portion B encircled by a broken line in FIG. 2 and taken along a broken line D in FIG. 5B. FIG. 5B shows the cross-sectional structure taken along a broken line C in FIG. 5A.

In the modification, a rib 241 is formed at the radially inner end of the impeller first protrusion 24 as shown in FIGS. 5A and 5B, for example. The rib 241 protrudes radially inward from the radially inner end of the impeller first protrusion 24 and extends in the axial direction. As described above, the flange recess 1124 is open at the upper surface of the flange 1123. For example, when the impeller 2 is attached to the rotor 11, the rib 241 is fitted in the flange recess 1124.

The present disclosure is not limited to the above example. The rib may be formed on the radially outer end of the flange 1123, and a recess to which the rib is fitted may be formed in the radially inner end of the impeller first protrusion 24. In this case, the rib formed on the flange 1123 protrudes radially outward from the radially outer end of the flange 1123. Further, the recess formed in the impeller first protrusion 24 is recessed radially outward from the radially inner end of the impeller first protrusion 24 and opens at the lower surface of the impeller first protrusion 24.

In the above modification, one of the radially inner end of the impeller first protrusion 24 and the radially outer end of the flange 1123 only needs to be provided with a rib. The rib protrudes from the one to the other along the radial direction. Further, the other of the radially inner end of the impeller first protrusion 24 and the radially outer end of the flange 1123 only needs to be provided with a recess which is recessed from the one to the other. The rib fits in the recess. Accordingly, the movement of the impeller first protrusion 24 in the circumferential direction relative to the flange 1123 can be prevented. Therefore, the rotation of the impeller 2 in the circumferential direction relative to the rotor 11 can be prevented.

Alternatively, instead of the abovementioned structure in which the rib fits in the recess, the radially inner end of the impeller first protrusion 24 may be connected to the radially outer end of the flange 1123 using an adhesive. In this case, preferably, a recess is formed in at least one of the impeller first protrusion 24 and the flange 1123. A portion of the adhesive for bonding the impeller first protrusion 24 and the flange 1123 is accommodated into the recess formed in at least one of them, so that the movement of the impeller first protrusion 24 in the circumferential direction relative to the flange 1123 can be prevented.

The example embodiment of the present disclosure has been described above. Note that the scope of the present disclosure is not limited to the above example embodiment. The present disclosure can be implemented by making various modifications to the abovementioned example embodiment without departing from the gist of the disclosure. In addition, the matters described in the above example embodiment can be arbitrarily combined together, as appropriate, as long as there is no inconsistency.

The present disclosure is useful for, for example, a blower device in which an impeller is attached to a motor.

Features of the above-described preferred example embodiments and the modifications thereof may be combined appropriately as long as no conflict arises.

While example embodiments of the present disclosure have been described above, it is to be understood that variations and modifications will be apparent to those skilled in the art without departing from the scope and spirit of the present disclosure. The scope of the present disclosure, therefore, is to be determined solely by the following claims.

What is claimed is:

1. A blower device comprising:

a rotor rotatable about a central axis extending in a vertical direction;

an impeller attached to the rotor; and a ring that is annular and centered on the central axis; wherein the rotor includes:

a rotor cylindrical portion extending in an axial direction; and a flange that extends radially outward from the rotor cylindrical portion;

the impeller includes an impeller base that is annular and centered on the central axis;

the ring is connected to the impeller base in the axial direction; and the flange is held between the impeller base and the ring in the axial direction.

2. The blower device according to claim 1, wherein the impeller base includes an impeller first protrusion protruding downward from a lower surface of the impeller base, the impeller first protrusion being disposed radially outward of the flange and connected to the ring.

3. The blower device according to claim 2, wherein a tip of the impeller first protrusion is welded to the ring.

4. The blower device according to claim 2, wherein the ring includes a ring first protrusion that protrudes upward at a position radially outward of the impeller first protrusion, the ring first protrusion facing the impeller first protrusion in a radial direction.

5. The blower device according to claim 4, wherein an impeller second protrusion is on the lower surface of the impeller base at a position radially outward of the ring first protrusion;

the impeller second protrusion includes:

a first lower surface located above the ring first protrusion;

a second lower surface located below an upper end of the ring first protrusion; and an inner side surface connecting a radially outer end of the first lower surface and a radially inner end of the second lower surface; and the inner side surface of the impeller second protrusion faces the ring first protrusion in the radial direction.

6. The blower device according to claim 2, wherein one of a radially inner end of the impeller first protrusion and a radially outer end of the flange is provided with a rib;

the rib protrudes from the one to the other along the radial direction;

the other of the radially inner end of the impeller first protrusion and the radially outer end of the flange is provided with a recess that is recessed from the one to the other; and the rib is fitted into the recess.

7. The blower device according to claim 1, wherein a lower surface of the flange is in pressing contact with the ring.

8. The blower device according to claim 7, wherein the ring includes a ring second protrusion protruding upward from an upper surface of the ring; and an upper end of the ring second protrusion is in pressing contact with the lower surface of the flange.

9. The blower device according to claim 7, wherein a pressure contact portion between the lower surface of the flange and the ring is located radially outward of a radially inner end of the ring.

10. The blower device according to claim 9, wherein the ring includes a groove that is recessed downward and extends in a circumferential direction in an upper surface;

the groove including at least one of:

a first groove recessed downward and extending in a circumferential direction at a position radially inward of the pressure contact portion; and a second groove recessed downward and extending in the circumferential direction at a position radially outward of the pressure contact portion.

11. The blower device according to claim 1, wherein a radially inner end of an upper surface of the ring includes an inclined surface that extends downward toward an inner side in the radial direction.

* * * * *